United States Patent [19]

Remmers

[11] Patent Number: 4,783,035

[45] Date of Patent: Nov. 8, 1988

[54] UNIVERSAL SUPPORT BRACKET FOR VENTILATED SHELVING

[75] Inventor: Lee Remmers, Ocala, Fla.

[73] Assignee: Clairson International, Ocala, Fla.

[21] Appl. No.: 53,463

[22] Filed: May 26, 1987

[51] Int. Cl.[4] ..... A47G 29/02

[52] U.S. Cl. ..... 248/250; 211/134; 248/558

[58] Field of Search ..... 248/235, 240, 249, 250, 248/558; 108/152, 149, 108; 211/134, 153, 90

[56] References Cited

U.S. PATENT DOCUMENTS

| | | | |
|---|---|---|---|
| 494,622 | 4/1893 | Bradley | 248/235 |
| 2,095,811 | 10/1937 | Goulooze | 211/153 X |
| 2,767,950 | 10/1956 | Bellon et al. | 211/153 X |
| 3,765,634 | 10/1973 | Stempel | 248/250 |
| 4,316,593 | 2/1982 | Miner et al. | 248/250 |
| 4,361,099 | 11/1982 | Kokenge et al. | 108/108 X |
| 4,374,498 | 2/1983 | Yellin | 248/250 X |
| 4,548,327 | 10/1985 | Kilkelly | 248/250 X |
| 4,662,595 | 5/1987 | Camilleri | 248/250 |

*Primary Examiner*—Ramon S. Britts
*Assistant Examiner*—Karen J. Chotkowski
*Attorney, Agent, or Firm*—Cushman, Darby & Cushman

[57] ABSTRACT

Apparatus for securing a rod type shelf to a vertical support such as a wall including a support bracket having a first end adapted to be secured to the vertical support at a point spaced vertically from the attachment of a rearward rod of the shelf to the vertical support structure and a second end for lockingly engaging and supporting a front support rod of the shelf. The second end includes a support face for supporting the shelf against rotation in a first direction towards the vertical support structure and a gripping portion for engaging the front support rod of the shelf and inhibiting rotation of the shelf in a second direction towards the vertical support structure. The gripping portion preferably includes at least one rod receiving slot so that it can be disposed in straddling relation to a tranverse rod of the shelf or can be disposed intermediate adjacent transverse rods of the shelf.

10 Claims, 3 Drawing Sheets

26
22
24
10
28
12
14
16
38
16
32
36
18
20

UNIVERSAL SUPPORT BRACKET FOR VENTILATED SHELVING

BACKGROUND OF THE INVENTION

The present invention is directed to a support bracket and, more particularly, to a support bracket for a shelf used in a rod-type ventilated shelving system, and which can be used to support the shelf either from above in a suspended manner or from below as a brace.

Support brackets for shelving systems are known, generally, as for example as shown in U.S. Pat. Nos. 494,622, 1,288,199, 2,268,237, 3,669,395, 4,361,099, and 4,374,498.

It has been found, however, that the prior art support brackets are disadvantageous in that a given bracket cannot be used both for suspending shelving system from above or, in the alternative, providing a below the shelf support depending on the particular shelving system in which the bracket is used or the wall area where use is desired. Further, the above-mentioned known support brackets cannot be quickly and easily mounted to its associated shelf so as to enable the simple and quick assembly of the shelving system as well as the rapid disassembly when so desired.

SUMMARY OF THE INVENTION

It is an object of the present invention to overcome the deficiencies of the prior art support brackets as set forth above. Accordingly, it is a primary object of the present invention to provide a universal support bracket which can be utilized as an above the shelf support for example in linen shelving systems or, in the alternative, can be provided so as to support an associated shelf from below when such a shelving system is preferred.

It is a further object of the present invention to provide a simple one piece support bracket which can be rapidly and inexpensively manufactured. It is also an object of this invention to provide a bracket which can be quickly and easily utilized in the assembly of a shelving system and thus can be readily installed by relatively unskilled homeowners.

To achieve the foregoing objects, the present invention provides a support bracket for a shelving system which can be efficiently and reliably mounted to any vertical wall surface, particularly those constructed of dry wall or the like. More particularly, the shelves themselves preferably comprise a plurality of spaced, parallel, transversely extending deck rods which are each welded at space points along a longitudinally extending support rod which extends along a rearward edge of the shelf. A similar longitudinal rod extends along the forward edge of the shelf. Further, the shelf may be of the type having a third longitudinally extending rod vertically disposed below the forward longitudinal rod and coupled thereto by either separate spaced support members or by extending the deck rods over and downwardly from the forward longitudinal rod so that they can be welded to the third longitudinal rod and form a front edge on the shelf. To provide additional support for the shelf structure when mounted to a wall or the like, a support bracket formed in accordance with the present invention is engaged with a portion of the forward longitudinal rod of the shelving structure.

The support bracket includes a first end having means for mounting the same to a vertical support such as a wall. The support bracket further includes a shaped and reinforced longitudinal main body portion which extends at an angle from the first end and terminates in a second end. The second end includes a stop face portion disposed in a plane substantially perpendicular to the longitudinal axis of the main body portion of the support bracket. Further, the second end includes an arcuate C-shaped portion which extends through an arc of about 180° from the stop face of the support bracket and a longitudinally extending slot that extends rearwardly along a control portion of the C-shaped portion. The arcuate C-shaped portion is sized so as to be engageable in surrounding relation to the longitudinal rod of an associated shelf. In this manner, when it is desired to utilize the support bracket as a below the shelf support, as shown in FIG. 1, the arcuate C-shaped portion of the support bracket is engaged with the longitudinal forward rod of the shelf from the rear with the main body portion extending downwardly and the slot engages in surrounding relation the forward portion of a deck rod or wire adjacent where the latter is welded to the forward longitudinal rod. In this manner, the stop face provides a seat for the longitudinal forward rod and together with the slot prevent the same from rotating angularly downwardly towards the vertical support wall. The first end of the support bracket can then be fastened to the associated vertical support to maintain the shelf in a horizontal relation when loads are placed upon the shelf.

Similarly, when it is desired to utilize the support bracket as a suspending support for the associated shelf, as shown in FIG. 2, the arcuate C-shaped portion is engaged with the longitudinal forward rod from the rearward direction with the main body of the support bracket extending upwardly from the associated shelf. In this manner, the stop face of the support bracket inhibits the upward rotation of the associated shelf in a direction toward the vertical support wall. Further, the arcuate C-shaped portion of the support bracket provides a seat for the longitudinal forward rod to prevent the same from swinging downwardly toward the vertical support structure. The first end of the support bracket is then fastened to the vertical support structure so as to complete the attachment of the support bracket and to provide support for the associated shelf in the presence of downward loads.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings all of which form a part of this specification, wherein like reference numerals designate corresponding parts in the various figures.

DETAILED DESCRIPTION OF THE PRESENTLY PREFERRED EXEMPLARY EMBODIMENT

Figure 1:
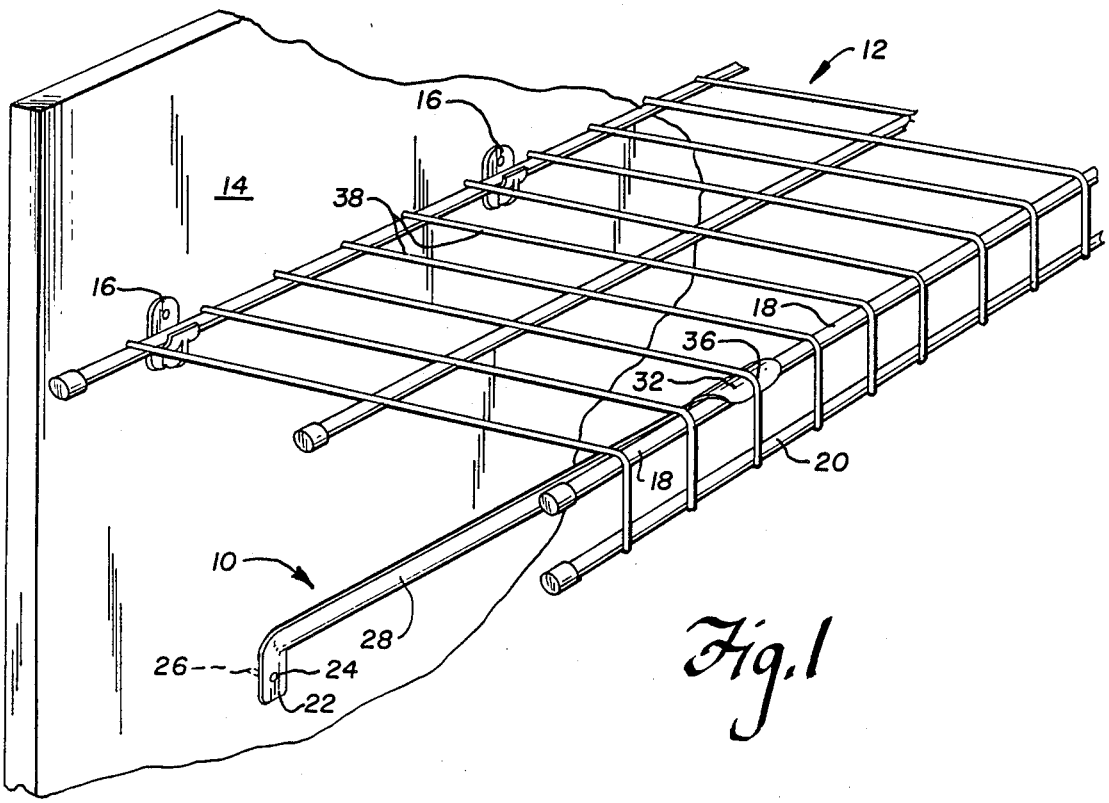
FIG. 1 i a perspective view of a universal support bracket formed in accordance with the present invention disposed as to provide a support for a shelf from below.

Referring to FIG. 1, a support bracket 10 formed in accordance with the present invention is shown mounted to an associated ventilated shelf 12 to provide support for the shelf from below. The rear longitudinal edge wire 17 of the shelf itself is coupled to an associated vertical support structure such as a wall 14 by means of a plurality of support clips 16 or the like. More particularly, ventilated shelf 12 is rotatably mounted within support clip 16 so that quick and easy installation of the same is facilitated.

Once the ventilated shelf has been attached to wall 14, of course, it is necessary for the shelf to be restrained from undesirable rotation when objects are placed upon the shelf and removed therefrom. Such support against rotation can be provided, as is known in the art, by end brackets (not shown) which are mounted to side walls of a closet, for example, so that the forward support rods 18, 20 of the shelf can be received and held therein. It has been found, however, that the portions of shelf 12 spaced from such end brackets can bow downwardly when heavy loads are placed thereon. Thus, in accordance with the present invention, an additional support in the form of support bracket 10 can be provided along the length of shelf 12 so as to minimize the likelihood of downward rotation of the shelf and, in particular, bowing of the shelf structure by supporting the longitudinal forward rod 18 of the associated shelf.

Figure 5:
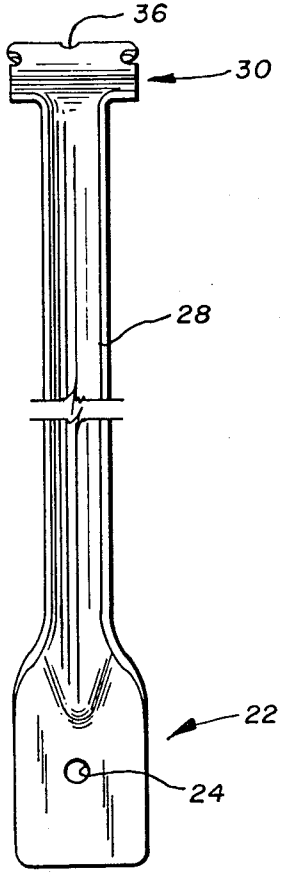
FIG. 5 is a rear elevational view of the bracket of FIG. 3.
Figure 4:
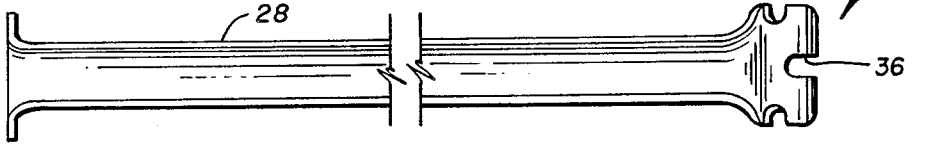
FIG. 4 is a top plan view of the bracket of FIG. 3.
Figure 3:
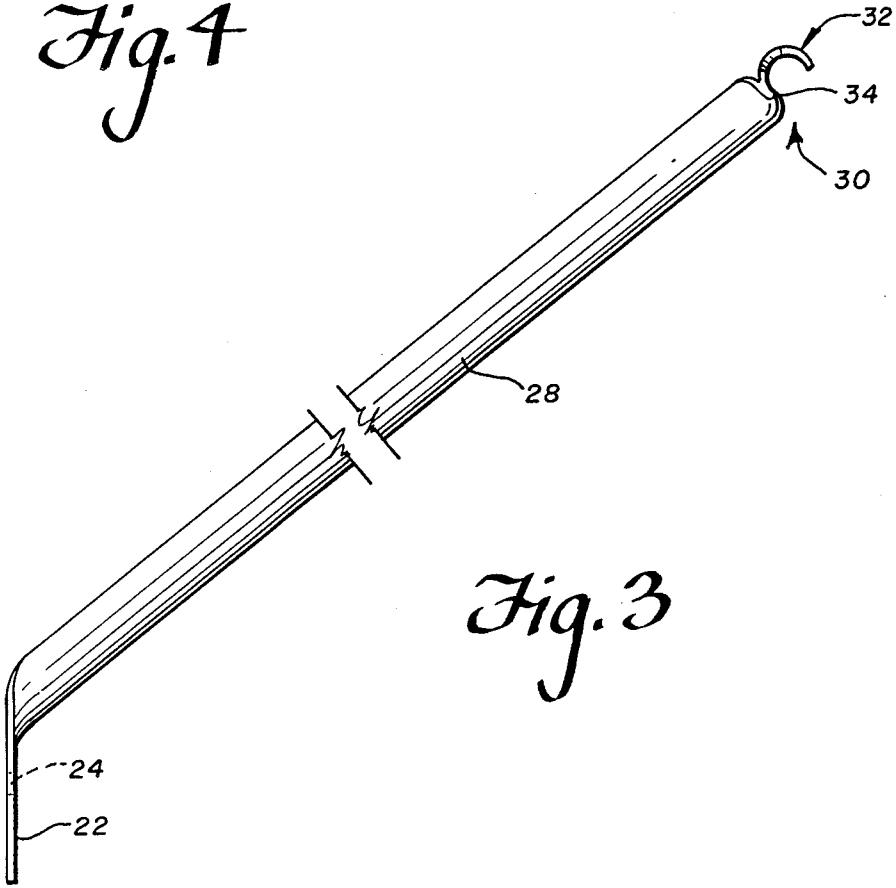
FIG. 3 is a side elevational view of a support bracket formed in accordance with the present invention.

Referring in particular to FIGS. 3–5, support bracket 10 formed in accordance with the preferred embodiment of the present invention includes a first end 22 including, for example, an aperture 24 for receiving a nail, screw or the like, shown generally as element 26, which is inserted through aperture 24 defined in a substantially flat plate member 22 provided at end of the bracket for coupling that end of bracket 10 to wall 14.

Figure 2:
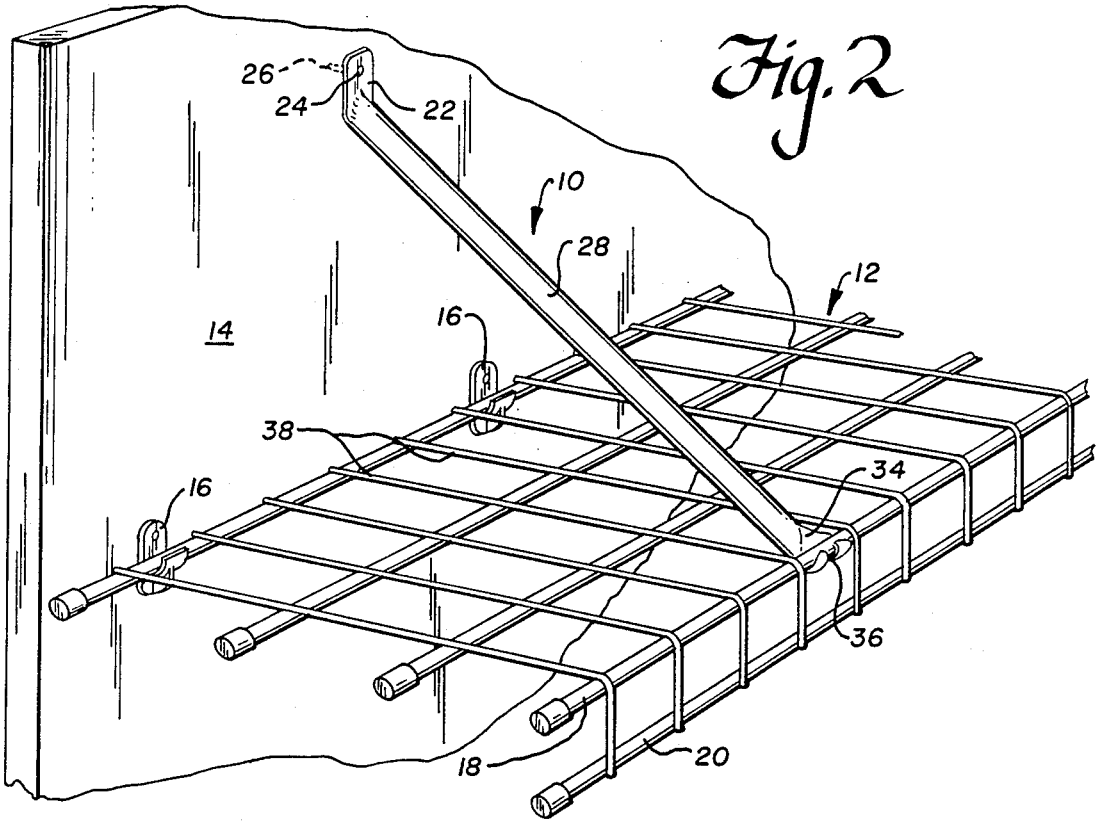
FIG. 2 is a perspective view of a universal support bracket formed in accordance with the present invention and coupled to an associated ventilated shelf so as to provide a suspending support for a shelf.

The support bracket further includes a longitudinal main body portion 28 which extends from first end 22 at an angle as can be seen in FIGS. 1, 2 and 3. While main body portion 28 of the support bracket can be formed of any rigid or substantially rigid material including wood, metal or plastic, in the preferred embodiment main body portion 28 of support bracket 10 is formed from flat plate steel which is stamped to the desired size and then folded as otherwise formed with a V or U-shaped cross-section to provide maximum support for loads placed on the associated shelf and to prevent undesirable rotation or bowing.

The second end 30 of support bracket 10 includes a gripping portion 32 for engaging a longitudinal forward rod 18 of the associated ventilated shelf 12. In the illustrated embodiment of the bracket 10, gripping portion 32 is in the form of an arcuate C-shaped clamping portion which extends through an angle of about 90° to about 270° from the stop face-34 defined by the second longitudinal end of main body portion 28.

The second end 30 of support bracket 10 can be formed of any suitable material but, in the preferred embodiment, is formed integrally with main body portion 28 and first end 22 of support bracket 10 and is preferably stamped from flat plate steel and subsequently formed into the arcuate configuration shown. The second end 30 also includes a longitudinal slot 36 defined along a portion of arcuate C-shaped portion 32 with slot 36 being dimensional to be able to receive a transverse deck wire 38 therein. Accordingly, the support bracket 10 can be placed either between transverse rods 38 of the ventilated shelving system, as shown in FIG. 2, or can be disposed so as to straddle a transverse deck rod 38, as shown in FIG. 1, which effectively locks the front edge of the shelf to the second end of the support bracket. Thus, the support bracket formed in accordance with the present invention is very versatile in that the particular location in which it is placed along the length of the shelf can be modified in accordance with the particular needs of the user.

When the support bracket formed in accordance with the present invention is used as a below the shelf support is shown in FIG. 1, gripping portion 32 is first hooked around a forward longitudinal rod 18 of the associated shelf, either between transverse rods 38 of shelf 12 or so as to straddle a particular transverse rod 38, as was discussed above. Support bracket 10 is then swung rearwardly so that its rearward, first end 22 can be fastened to wall 14 to dispose the shelf in a horizontal plane. Of course, the length of the bracket, the angle between main body portion 28 and first end 22, and the width of shelf 12 can be selected so that a shelf having an upward tilt or a downward tilt could also be provided. In addition, the system can be assembled such that the shelves are "flipped over" from the illustrated disposition and can be supported or suspended from either forward longitudinal rod 18 or 20. After end 22 has been fastened to wall 14 the associated shelf will be positioned at the desired angle with respect to the wall, stop face portion 34 of the support bracket will provide a seat upon which the forward longitudinal rod 18 or 20 of the shelf will rest when loads are placed upon the shelf. Likewise, forces tending to rotate the shelf upwardly relative to the support bracket will be resisted by the arcuate C-shaped portion 32 through its engagement with the upper and rearward portion of the forward longitudinal rod 18 or 20 of the shelf.

As is apparent, then, the support bracket formed in accordance with the present invention may be quickly and easily attached to the forward longitudinal rod of an associated shelving member so as to facilitate the ease of assembly of the ventilated shelving system as a whole and to provide a stable and useful shelving system in accordance with a consumer's needs.

Referring to FIG. 2, in particular, universal support bracket 10 of the present invention is shown in a second supporting position. As can be seen, in this configuration the arcuate C-shaped portion 32 of support bracket 10 is engaged with longitudinal forward rod 18 of the associated shelf from behind with main body portion 28 extending upwardly at an angle relative to ventilated shelf 12. When support bracket 10 is utilized in this manner, it is coupled to the longitudinal forward rod 18 of shelf 12 and to wall 14 in a manner analogous to the first orientation of the support bracket but the support bracket itself is simply turned upside down from the orientation shown in FIG. 1 and coupled to the forward rod 18 of the shelf and to the wall as a mirror image to the first orientation, discussed above. As is apparent, when the support bracket is coupled to the shelf to provide such suspending support, as shown in FIG. 2, C-shaped arcuate portion 32 of second end 30 of support bracket 10 provides a seat for longitudinal forward rod 18 of shelf 12, preventing the same from rotating downwardly from its horizontal or particular desired angular orientation. Furthermore, stop face 44 defined at the second longitudinal end of main body portion 28 prevents upward and rearward rotation of the shelf when exposed to displacing forces which tend to rotate the same in this manner.

Figure 6:
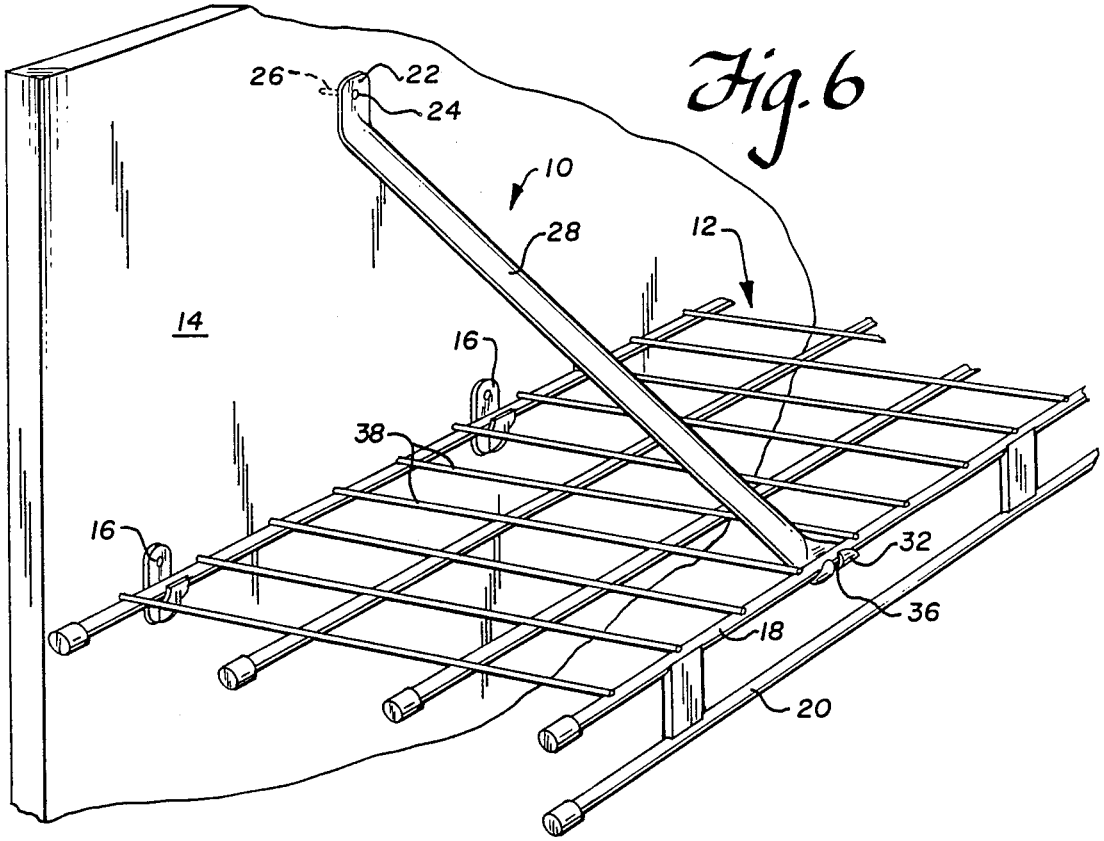
FIG. 6 is a perspective view partly broken away clarity showing the support bracket used as a suspending support for a drop rod type shelf.

As is apparent from the foregoing, a support bracket formed in accordance with the present invention is universal in that it can be attached from the bottom of the shelf to provide a below the shelf support as well as from above to provide a reverse suspending support for the shelf. In addition, the bracket can be used with a linen type shelf as shown in FIGS. 1 and 2 or with a drip rod type shelf as shown in FIG. 6. Thus, a support bracket which can be rapidly and inexpensively manufactured as a once piece unit and can be effectively secured to an associated shelf in a manner that is particularly suited to a consumers needs.

While the invention has been described in connection with what is presently considered to be the most practical and preferred embodiments, it is to be understood that the invention is not to be limited to the disclosed embodiment, but on the contrary, it is intended to cover various modifications and equivalent arrangements included within the spirit and the scope of the appended claims.

What is claimed is:

1. A shelving system comprising:

at least one shelf defining a substantially planar surface and including a plurality of spaced, parallel, transversely extending deck rod members, said rod members being coupled to and extending at least between a longitudinally extending rear support rod and a longitudinally extending front support rod of the shelf, respectively;

means for mounting a said rear support rod to an adjacent vertical support structure; and means for supporting a said front support rod of said shelf including a support bracket having a longitudinal main body portion, a first end portion defined at a first longitudinal end of said main body portion for mounting the support bracket to the vertical support structure, and a second end portion defined at a second longitudinal end of said main body portion, said second longitudinal end including a stop face which defines a seat for limiting rotational movement of said front support rod relative to said means for mounting said rear support rod and means for receiving and gripping a portion of the circumference of said front support rod, said means for receiving and gripping including an arcuate portion extending in the longitudinal direction of said main body portion from said stop face defining therewith an arcuate recess having a longitudinal axis coincident with a longitudinal axis of said front support rod and parallel to a plane of said vertical support structure, said arcuate portion including at least one slot means extending transversely to said longitudinal axis of said arcuate recess and receiving a said parallel deck rod member of said shelf when said means for supporting is mounted to said shelf.

2. A shelving system as in claim 1, wherein said arcuate portion is an arcuate C-shaped element which extends in an arc of between about 90° and about 270° from said stop face.

3. A shelving system as in claim 1, wherein said first end portion includes a flat plate member having an aperture defined therein for receiving a fastening device for fastening said first end to the vertical support structure.

4. A shelving system as in claim 3, wherein said main body portion of said support bracket extends at an angle from a plane of said flat plate first end portion.

5. A shelving system as in claim 4, wherein aid longitudinal main body portion extends at an angle of between about 0° and about 90° from said first end portion.

6. A support bracket for supporting a shelf mounted to a vertical support structure and including a longitudinal front support rod and at least one transverse rod member, comprising:

a longitudinal main body portion;

a first end portion defined at a first longitudinal end of said longitudinal end of said longitudinal main body portion for mounting the bracket to a vertical support structure to which the shelf is mounted; and a second end portion defined at a second longitudinal end of said main body portion, said second longitudinal end including a stop face which defines a seat means for limiting rotational movement of said front support rod relative to the vertical support structure and means for receiving and gripping a portion of the circumference of the front support rod of the shelf, said means for receiving and gripping including an arcuate portion extending in the longitudinal direction of said main body portion from said stop face and defining therewith an arcuate recess having a longitudinal axis extending perpendicular to the longitudinal axis of the main body portion and coincident with a longitudinal axis of the front support rod of a shelf to which it is mounted and parallel to a plane of the vertical support structure to which the first end portion is mounted, said arcuate portion including at least one slot means extending transversely to said longitudinal axis of said arcuate recess and sized so as to receive a transverse rod member of the shelf.

7. A support bracket as in claim 6, wherein said arcuate portion is an arcuate C-shaped element which extends in an arc of between about 90° and about 270° from said stop face.

8. A support bracket as in claim 6, wherein said first end portion includes a flat plate member having an aperture defined therein for receiving a fastening device for fastening said first end to the vertical support structure.

9. A support bracket as in claim 8, wherein said main body portion of said support bracket extends at an angle from a plane of said flat plate first end portion.

10. A support bracket as in claim 9, wherein said longitudinal main body portion extends at an angle of between about 0° and about 90° from said first end portion.

* * * * *